US008013796B2

(12) United States Patent
Liu et al.

(10) Patent No.: US 8,013,796 B2
(45) Date of Patent: Sep. 6, 2011

(54) DUAL-BAND ANTENNA

(75) Inventors: Hsin-Hung Liu, Tu-Cheng (TW); Tsung-Lin Hsieh, Tu-Cheng (TW)

(73) Assignee: Chi Mei Communications Systems, Inc., Tu-Cheng, New Taipei (TW)

( * ) Notice: Subject to any disclaimer, the term of this patent is extended or adjusted under 35 U.S.C. 154(b) by 443 days.

(21) Appl. No.: 12/251,550

(22) Filed: Oct. 15, 2008

(65) Prior Publication Data

US 2010/0033381 A1 Feb. 11, 2010

(30) Foreign Application Priority Data

Aug. 11, 2008 (CN) ..... 2008 1 0303644

(51) Int. Cl.
*H01Q 1/24* (2006.01)

(52) U.S. Cl. ..... 343/702

(58) Field of Classification Search ..... 343/700 MS, 343/702, 767
See application file for complete search history.

(56) References Cited

U.S. PATENT DOCUMENTS

| | | | | |
|---|---|---|---|---|
| 2008/0169989 | A1* | 7/2008 | Li et al. | 343/713 |
| 2008/0179803 | A1* | 7/2008 | Shew et al. | 269/13 |
| 2008/0309563 | A1* | 12/2008 | Wang et al. | 343/702 |
| 2009/0079643 | A1* | 3/2009 | Lin et al. | 343/745 |
| 2009/0179803 | A1* | 7/2009 | Tsai et al. | 343/700 MS |
| 2009/0289859 | A1* | 11/2009 | Pan | 343/702 |

* cited by examiner

*Primary Examiner* — Huedung Mancuso
(74) *Attorney, Agent, or Firm* — Altis Law Group, Inc.

(57) ABSTRACT

An dual-band antenna (100) used in a portable electronic device includes a first antenna unit (10) configured for receiving and/or sending wireless signals in low frequency bands, a second antenna unit (20) configured for receiving and/or sending wireless signals in high frequency bands; a feed unit (30) and a grounding unit (40). The first antenna unit, the second antenna unit and the feed unit are all connected to the grounding unit. A portion of the first antenna unit is positioned between the second antenna unit and the grounding unit. The first antenna unit and the second antenna unit are respectively positioned in different parallel planes.

13 Claims, 1 Drawing Sheet

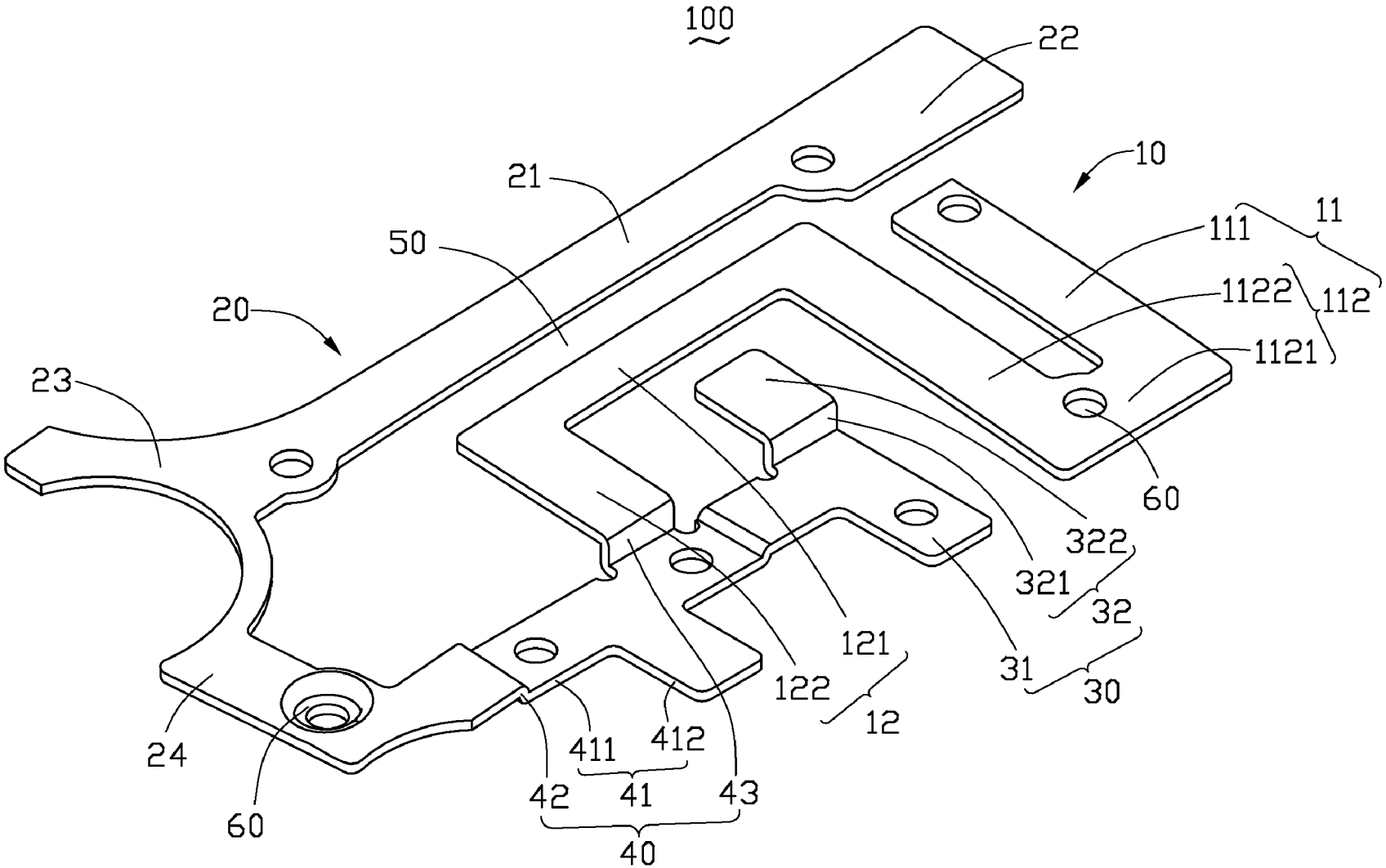
100
10
11
111
112
1122
1121
60
22
322
321
32
30
31
121
12
122
43
412
41
411
40
42
21
50
20
60
24
23

DUAL-BAND ANTENNA

BACKGROUND

1. Field of the Invention

The present invention generally relates to antennas, particularly to a dual-band antenna used in portable electronic devices.

2. Description of Related Art

Antennas are important components of mobile phones. Today, most mobile phones use dual-band antennas to replace former single-band antennas for improving communicating quality. However, conventional dual-band antennas used in mobile phones are usually planar antennas. Planar antennas are generally large and need a lot of space to be installed in a mobile phone. Thus, mobile phones having dual-band antennas can be difficult to miniaturize.

Additionally, when a planar antenna is installed in a mobile phone, it is usually positioned close to a circuit board in the mobile phone. Thus, the planar antenna, particularly the part of the antenna configured for receiving and/or sending low frequency wireless signals, may be interfered with by electric radiation of the circuit board.

Therefore, there is room for improvement within the art.

BRIEF DESCRIPTION OF THE DRAWING

Many aspects of the antenna can be better understood with reference to the following drawings. The components in the drawings are not necessarily drawn to scale, the emphasis instead being placed upon clearly illustrating the principles of the antenna.

The drawing is a schematic view of a dual-band antenna, according to an exemplary embodiment.

DETAILED DESCRIPTION OF THE EMBODIMENT

The drawing shows a dual-band antenna 100 according to an exemplary embodiment. In use, the dual-band antenna 100 is installed in a portable electronic device (not shown), such as a mobile phone, to receive and/or send wireless signals.

The dual-band antenna 100 can be formed by punching and bending a sheet of conductive material, such as metal. The dual-band antenna 100 includes a first antenna unit 10, a second antenna unit 20, a feed unit 30 and a grounding unit 40. The first antenna unit 10, the second antenna unit 20 and the feed unit 30 are all connected to the grounding unit 40.

The first antenna unit 10 is for receiving and/or sending wireless signals in low frequency bands. The first antenna unit 10 is a zigzag board including an approximately U-shaped first antenna member 11 and an approximately L-shaped second antenna member 12 connected to an end of the first antenna member 11. The first antenna member 11 and the second antenna member 12 are coplanar.

The first antenna member 11 includes a first band portion 111 and an L-shaped portion 112. The L-shaped portion 112 has a first band section 1121 and a longer second band section 1122. One end of the first band section 1121 is perpendicularly connected to one end of the second band section 1122, and another end of the first band section 1121 is perpendicularly connected to one end the first band portion 111. Thus, the first band portion 111 is parallel to the second band portion 1122.

The second antenna member 12 is an approximately L-shaped board, and includes a second band portion 121 and a third band portion 122. One end of the second band portion 121 is perpendicularly connected to one end of the second band section 1122 which is opposite to the end connected to the first band section 1121. Another end of the second band portion 121 is perpendicularly connected to an end of the third band portion 122. Thus the third band portion 122 is parallel to the first band portion 111 and the second band section 1122.

The second antenna unit 20 is for receiving and/or sending wireless signals in high frequency bands. The second antenna unit 20 includes an approximately band-shaped main portion 21. One end of the main portion 21 forms an enlarged first mounting portion 22. A semicircular arc-shaped assembling portion 23 is formed at another end of the main portion 21. A middle portion of the assembling portion 23 is connected to the main portion 21, and one end of the assembling portion 23 extends along a direction perpendicular to its tangent to form an approximately L-shaped second mounting portion 24. The main portion 21, the first mounting portion 22 and the assembling portion 23 are coplanar.

The feed unit 30 is an approximately T-shaped board, and includes a feed portion 31 and a first connecting portion 32 connected to the feed portion 31. The feed portion 31 is an approximately L-shaped board. The first connecting portion 32 includes a first link component 321 and a first extending section 322. The feed portion 31 and the first extending section 322 are respectively positioned in different parallel planes. The first link component 321 is perpendicularly connected between one end of the feed portion 31 and one side of the extending section 322 to form the feed unit 30.

The grounding unit 40 includes a grounding portion 41, two second connecting portions 42 and a second link component 43. The grounding portion 41 is an approximately T-shaped board and includes a band-shaped grounding section 411 and a second extending section 412 perpendicularly connected to a middle portion of the grounding section 411. Two ends of the grounding section 411 are bent to form the two second connecting portions 42 perpendicular to the grounding portion 411. The second link component 43 is a board perpendicularly connected to one side of the grounding section 411 opposite to the second extending section 412 and adjacent to one second connecting portion 42. An elevation of the second link component 43 is higher than that of the two second connecting portions 42.

In fabrication, an end of the third band portion 122 is perpendicularly connected to the second link component 43. An end of the feed portion 31 is perpendicular to one second connecting portion 42 adjacent to the second link component 43, and the first extending section 322 is positioned parallel to the first band portion 111, the second band section 1122 and the third band portion 122. One end of the second mounting portion 24 is perpendicularly connected to another second connecting portion 42. The main portion 21 is positioned parallel to the second band portion 121 and the grounding section 411. The first antenna unit 10 and the second antenna unit 20 are positioned on a same side of the grounding unit 40, and the first antenna unit 10 is positioned between the grounding unit 40 and the second antenna unit 20. In this way, the first antenna unit 10, the second antenna unit 20 and the feed unit 30 are all connected to the grounding unit 40 to form the dual-band antenna 100, and these units are respectively positioned in different parallel planes.

Since the first antenna unit 10 and the second antenna unit 20 are positioned on a same side of the grounding unit 40, a gap 50 is formed between the main portion 21 and the second band portion 121. The working frequency of the dual-band antenna 100 can be adjusted by changing a width of the gap 50.

In assembly, the dual-band antenna 100 is installed in a mobile phone (not shown). A plurality of assembling holes 60 can be defined in the dual-band antenna 100, particularly in the first band portion 111, the first band section 1121, the first mounting portion 22, the second mounting portion 24. Thus, the dual-band antenna 100 can be secured in the mobile phone using the assembling holes 60. The assembling portion 23 can be used to engage with inner components of the mobile phone.

In use, the feed unit 30 is used to transmit communicating signals, and the grounding unit 40 provides a ground. The first antenna unit 10 and the second antenna unit 20 can be used to receive and/or send wireless communicating signals. Thus, the mobile phone can be used in two frequency bands.

Since an elevation of the second link component 43 is higher than that of the two second connecting portions 42, the first antenna unit 10 and the second antenna unit 20 are positioned in different parallel planes. Compared with conventional planar antennas, the dual-band antenna 100 utilizes inner space in mobile phones more efficiently, which is advantageous to miniaturization of mobile phones.

Further, in the dual-band antenna 100, the first antenna unit 10 configured for receiving and/or receiving low frequency wireless signals is positioned between the grounding unit 40 and the second antenna unit 20. Thus, the first antenna unit 10 can be more advantageously shielded from radiation of circuits of the mobile phone, and the dual-band antenna has improved communicating quality.

It is believed that the exemplary embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An dual-band antenna used in a portable electronic device, comprising:

a first antenna unit configured for receiving and/or sending wireless signals in low frequency bands;

a second antenna unit configured for receiving and/or sending wireless signals in high frequency bands;

a feed unit; and a grounding unit, wherein the first antenna unit, the second antenna unit and the feed unit are all connected to the grounding unit, a portion of the first antenna unit is positioned between the second antenna unit and the grounding unit, both the first antenna unit and the second antenna unit are substantially planar boards, and the first antenna unit and the second antenna unit are respectively positioned in two parallel planes.

2. The dual-band antenna as claimed in claim 1, wherein the first antenna unit is a zigzag board including a U-shaped first antenna member and an L-shaped second antenna member connected to one end of the first antenna member, the first antenna member and the second antenna member being coplanar.

3. The dual-band antenna as claimed in claim 2, wherein the first antenna member includes a first band portion and an L-shaped portion, the L-shaped portion having a first band section and a longer second band section, one end of the first band section being connected to one end of the second band section, and another end of the first band section being connected to one end the first band portion.

4. The dual-band antenna as claimed in claim 3, wherein the second antenna member is an L-shaped board including a second band portion and a third band portion, one end of the second band portion being connected to one end of the second band section, another end of the second band portion being connected to an end of the third band portion, thus the third band portion being parallel to the first band portion and the second band section.

5. The dual-band antenna as claimed in claim 1, wherein the second antenna unit includes a band-shaped main portion, one end of the main portion forming an enlarged first mounting portion.

6. The dual-band antenna as claimed in claim 5, wherein the second antenna unit includes a semicircular arc-shaped assembling portion formed at another end of the main portion, a middle portion of the assembling portion being connected to the main portion, and one end of the assembling portion extending to form an L-shaped second mounting portion.

7. The dual-band antenna as claimed in claim 6, wherein the main portion, the first mounting portion and the assembling portion are coplanar.

8. The dual-band antenna as claimed in claim 1, wherein the feed unit is a T-shaped board including a feed portion and a first connecting portion connected thereto, the feed portion being an L-shaped board, the first connecting portion including a first link component and a first extending section, the feed portion and the first extending section being respectively positioned in two parallel planes, the first link component being perpendicularly connected between one end of the feed portion and the corner of the extending section.

9. The dual-band antenna as claimed in claim 1, wherein the grounding unit includes a grounding portion, two second connecting portions and a second link component formed thereon; the grounding portion being a T-shaped board which includes a band-shaped grounding section and a second extending section connected thereto; two ends of the grounding section bent to form the two second connecting portions; the second link component being a board perpendicularly connected to one side of the grounding section that is opposite to the second extending section and adjacent to one second connecting portion.

10. The dual-band antenna as claimed in claim 9, wherein the first antenna unit is connected to the second link component, the feed portion is connected to one second connecting portion that is adjacent to the second link component, and the second antenna unit is connected to another second connecting portion.

11. The dual-band antenna as claimed in claim 1, wherein a gap is formed between the first antenna unit and the second antenna unit, changing a width of the gap after the dual-band antenna is constructed adjusts the working frequency of the dual band antenna.

12. The dual-band antenna as claimed in claim 1, wherein a plurality of assembling holes are defined therein for securing the dual-band antenna in the portable electronic device.

13. The dual-band antenna as claimed in claim 1, wherein the first antenna unit is shielded from radiation of circuits of the mobile phone by the second antenna unit and the grounding unit due to the portion of the first antenna unit positioned between the second antenna unit and the grounding unit.

* * * * *